US007112256B2

(12) United States Patent
Snekkenes et al.

(10) Patent No.: US 7,112,256 B2
(45) Date of Patent: Sep. 26, 2006

(54) METHOD FOR CONTINUOUS COOKING OF CHEMICAL PULP TO IMPROVE HEAT ECONOMY

(75) Inventors: Vidar Snekkenes, Karlstad (SE); Lennart Gustavsson, Karlstad (SE)

(73) Assignee: Kvaerner Pulping AB (SE)

( * ) Notice: Subject to any disclaimer, the term of this patent is extended or adjusted under 35 U.S.C. 154(b) by 310 days.

(21) Appl. No.: 10/250,886

(22) PCT Filed: Jan. 22, 2003

(86) PCT No.: PCT/SE03/00096

§ 371 (c)(1),
(2), (4) Date: Oct. 22, 2003

(87) PCT Pub. No.: WO03/062525

PCT Pub. Date: Jul. 31, 2003

(65) Prior Publication Data

US 2004/0060672 A1 Apr. 1, 2004

(30) Foreign Application Priority Data

Jan. 24, 2002 (SE) ..... 0200185

(51) Int. Cl.
*D21C 7/14* (2006.01)
*D21C 11/00* (2006.01)

(52) U.S. Cl. ..... 162/19; 162/37; 162/39; 162/40; 162/47

(58) Field of Classification Search ..... 162/19, 162/37, 39, 40, 41, 43, 47, 62, 237, 249, 162/250, 251
See application file for complete search history.

(56) References Cited

U.S. PATENT DOCUMENTS

| | | | | |
|---|---|---|---|---|
| 5,089,086 | A | | 2/1992 | Silander |
| 5,679,217 | A | | 10/1997 | Outzen et al. |
| 5,716,497 | A | | 2/1998 | Richter et al. |
| 5,824,187 | A | | 10/1998 | Richter et al. |
| 6,123,807 | A | * | 9/2000 | Engstrom et al. ..... 162/17 |

* cited by examiner

*Primary Examiner*—Steve Alvo
(74) *Attorney, Agent, or Firm*—Rolf Fasth; Fasth Law Offices

(57) ABSTRACT

A method for the continuous cooking of chemical pulp with the aim of achieving improved heat economy in a digester system having a vessel (1) for impregnation and a vessel (2) for cooking the impregnated cellulose chips. A part of the black liquor (14) withdrawn from the digester (2) is added at the beginning of a transfer system (4) to increase the temperature of the chips mixture in the transfer system (4). A fraction of the transport fluid (10) from the transfer system (4) that is continuously withdrawn from the impregnated chips fed into the top of the digester is returned to the impregnation vessel (1) at essentially the maintained transfer temperature.

13 Claims, 4 Drawing Sheets

METHOD FOR CONTINUOUS COOKING OF CHEMICAL PULP TO IMPROVE HEAT ECONOMY

PRIOR APPLICATION

This application is a U.S. national phase application based on International Application No. PCT/SE03/00096, filed 22 Jan. 2003, claiming priority from Swedish Patent Application No. 0200185-7, filed 24 Jan. 2002.

TECHNICAL AREA

The present invention concerns a method for the continuous cooking of cellulose according to the introduction to claim 1 with the aim of achieving improved heat economy during impregnation with black liquor.

THE PRIOR ART

The technique of impregnation with black liquor was developed during the latter part of the 1980s and the 1990s, as part of the development of processes for continuous cooking, with the aim of obtaining improved cooking economy and heat economy and of obtaining better pulp impregnation with black liquor is characterised in that the impregnation fluid is partially or fully constituted by withdrawn cooking fluid, known as black liquor, from various locations in the digester, with a higher level of residual alkali than previous cooking processes in which withdrawn cooking fluid was passed on for recovery of chemicals. The principal aim of impregnation with black liquor is to obtain pulp with a higher quality than that of pulp that is manufactured with impregnation with white liquor, while a further aim is to preserve to a greater degree the heat of the black liquor withdrawn from the digester in order to heat the cold chips in the impregnation vessel. A certain amount of the heat of the black liquor had previously been retained in the cooking process such as steam, known as flash steam, from the flash cyclones, which was used, among other purposes, for steaming the chips.

A continuous cooking process is revealed by U.S. Pat. No. 5,192,396 in which black liquor from the digester is fed indirectly to the top and bottom of the impregnation vessel via flash cyclones. The impregnation vessel is provided with an upper concurrent impregnation zone and a lower countercurrent impregnation zone. The black liquor that is transferred to the bottom of the impregnation vessel is mixed with the return flow of the transfer circulation and passed through a heat exchanger in which the temperature is raised to boiling point before the liquor is lead into the bottom of the impregnation vessel. The aim of the method is to obtain a higher ratio of fluid to wood at the bottom of the impregnation vessel and at the inlet to the digester, something that has a positive influence on the downward motion of the column of chips at the top of the digester, while at the same time the concentration of alkali in the digester becomes lower, which reduces the initial breakdown of carbohydrates during the cooking process.

A second method for the optimisation of the ratio of fluid to wood in impregnation vessels and in digesters is revealed in U.S. Pat. No. 5,679,217. The liquor in the transfer circulation is separated into a part at the top separator of the digester and a remainder in a strainer section lower in the digester. This return liquor is led collected through a heat exchanger for heating back to the outlet arrangement at the bottom of the impregnation vessel. A subcurrent of this impregnation liquor, however, is led without heating to the top of the impregnation vessel such that an increased ratio of fluid to wood is obtained at the top of the impregnation vessel. The method allows a lower ratio of fluid to wood to be obtained in the upper part of the digester than that which is obtained if black liquor from a strainer section lower in the digester is used to increase the ratio of fluid to wood according to U.S. Pat. No. 5,192,396. The advantages, according to the patent, include the ability to decrease the degree of packing at the top of the digester without a disadvantageous influence on the transfer of chips between the impregnation vessel and the digester, and the fact that the flow of steam for heating at the top of the digester can be reduced somewhat, since the temperature of the transfer becomes higher.

A method for impregnation with black liquor is known through U.S. Pat. No. 5,716,497 in which a certain amount of black liquor from the digester is mixed with the return liquor from the transfer circulation between the impregnation vessel and the digester without any cooling taking place before this mixture is supplied to the bottom of the impregnation vessel. Part of this mixture will return with the impregnated chips in the transfer circulation and the remainder will be carried in a countercurrent flow up through the impregnation vessel and will be withdrawn at a strainer section at the upper part of the vessel during heating of the chips and expulsion of wood moisture and steam condensate from the chips. Regulation of the amount of black liquor supplied to the bottom of the impregnation vessel allows a thorough impregnation to be ensured, and this can be controlled by maintaining the temperature of the material withdrawn from the strainer section at the upper part of the impregnation vessel warmer than the mixture of chips and fluid that is fed in at the top of the impregnation vessel. All white liquor is, according to the patent, added in batches at the top of the digester, which allows expensive central pipes to be avoided. A further advantage of the method is an improvement in the quality of the pulp since the cellulose fibers are not weakened by mechanical treatment of the bottom scraper during output from the impregnation vessel, a weakening which is considerable when white liquor is used as impregnation fluid. A method with the same aim is presented in U.S. Pat. No. 5,824,187, being a Continuation in part of the above patent, in which impregnation with black liquor takes place in a concurrent flow and without any mixing of the transfer circulation with this black liquor.

A process for continuous cooking with black liquor impregnation is revealed in U.S. Pat. No. 6,123,807, one aim of which is to obtain an improved heat economy. The black liquor withdrawn from the digester is transferred to a first flash cyclone and subsequently onwards to the beginning of the impregnation zone in order to constitute impregnation fluid either in an impregnation vessel in a two-vessel digester, or to an impregnation zone at the top of a digester in a one-vessel digester. The flash steam obtained from the flash cyclone is used to directly heat the white liquor that is added to the cooking process. The "impregnation fluid" is withdrawn after the impregnation zone for transport to recovery of chemicals via a second, and possibly also a third, flash cyclone. Although the method does give a better heat economy than known methods, heat losses still take place in those stages that lead to a reduction in temperature, and thus there exists a potential for further improvements in this respect.

A continuous cooking process is revealed in U.S. Pat. No. 5,089,086, the main aim of which is to improve heat economy. However, this is not a process for impregnation with black liquor. The process is characterised in that essentially all hot liquor withdrawn from the digester is used to transport the impregnated chips from the bottom of the impregnation vessel to the top of the digester. The hot liquor withdrawn from the digester is led, possibly without previous reduction in pressure and the fall in temperature that accompanies it, into the bottom of the impregnation vessel into a mixing zone where it is mixed with impregnated chips and impregnation fluid for transport to the top of the digester. The temperature of the chips and the fluid can in this way be raised, reducing the need of heating at the top of the digester in order to obtain the correct cooking temperature. Part of the transport fluid is separated from the conventional top separator to a flash cyclone where part of the transport fluid is returned, following reduction in pressure, together with the liquor that has been withdrawn, to the bottom of the impregnation vessel. The pressure of the remainder of the transport fluid, which corresponds to the amount of cooking fluid withdrawn, is subsequently reduced in further stages, such that the fluid can be taken away for recovery of chemicals. Thus the problem of too high a temperature of the impregnation fluid does not arise in this case. Neither is it indicated that it would be desirable to retain the heat in any other method than as flash steam in the transport fluid that is led to chemical recovery following its separation from the chip mixture in the top separator at the top of the digester.

As the description of the prior art given above makes clear, impregnation was initially often carried out with at least a final zone of countercurrent flow. Black liquor at a high temperature, typically over 140° C., was often added at this location, in order to obtain in this manner rapid heating of the chips. A high temperature was considered to be an advantage in the older methods of black liquor impregnation such that the impregnation should take place rapidly and become efficient. It was considered that impregnation in countercurrent flow was particularly advantageous for a thorough impregnation. The temperature of the transfer could, at the same time, be maintained at a high level whereby the need for heating at the top of the digester was reduced. The trend in recent years has been towards impregnation at lower temperatures and with a greater part of the impregnation taking place with a concurrent flow. This has involved the need for cooling of the black liquor from the digester which has occurred either through flashing and/or through cooling in a heat exchanger. A lower temperature during impregnation produces the need to heat the chips when they pass onwards to the digester. This has been achieved using heaters in the transfer circulation. Unavoidable energy losses arise during indirect heat transfer and it is thus desirable to discover methods that allow impregnation at low temperature where the heat in the black liquor can be preserved for use in the digester without these energy losses arising, or at least being minimised. Hot black liquor can, with the aim of improving the heat economy during the cooking process, be introduced into the bottom zone of the impregnation vessel in order to raise the temperature of the chips before the digester, something that is revealed in U.S. Pat. No. 5,089,086. However, impregnation takes place in this case using a fluid other than black liquor, which fluid must be heated in order to obtain the correct temperature.

BRIEF DESCRIPTION OF THE INVENTION

There is offered through the present invention a method for the continuous cooking of cellulose in a two-vessel digester system in which impregnation takes place in an impregnation fluid that consists at least partially of black liquor. The method makes impregnation at low temperatures possible, something that is in line with the latest developments within the technology of black liquor impregnation, while at the same time the requirement for cooling of the black liquor for the impregnation vessel is reduced or eliminated. The method also reduces or eliminates the requirement for heating in the transfer line between the impregnation vessel and the digester, which indirectly reduces the consumption of clean steam or flash steam, which can thus be used for other purposes, and it reduces the requirement for the addition of steam at the top of the digester in order to rapidly raise the temperature of the chips to cooking temperature. The method ensures an improved heat economy relative to that which is previously known in that the energy losses that unavoidably arise during heat exchange, flashing, etc., are lower. This is achieved with a method according to claim 1.

The method is applied in one preferred embodiment such that the requirement for coolers of black liquor and the requirement of heaters for the transfer are both eliminated, and in this way a further aim is achieved in that the cost of a digester system according to the invention will be lower than previously known systems. The cost will be lower also in an non-optimal embodiment with lower cooking and heating requirements, since these heaters and coolers can be made considerably smaller, and thus cheaper. Further properties and aspects, together with advantages, of the invention are made clear by the attached claims and the following detailed descriptions of some embodiments.

DETAILED DESCRIPTION OF THE INVENTION

Figure 1:
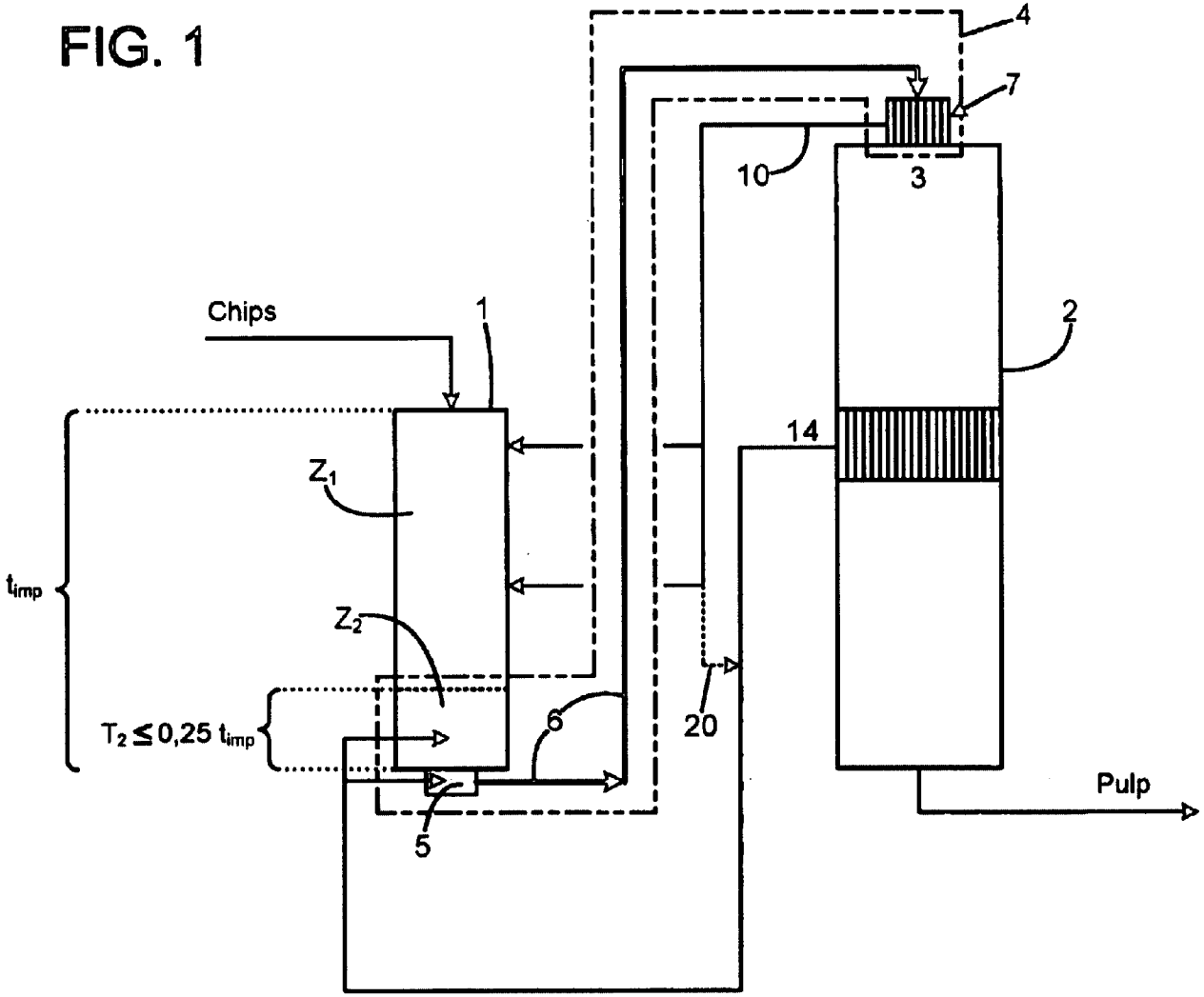
FIG. 1 shows schematically one preferred embodiment of a two-vessel digester in which the invention is applied.
Figure 2:
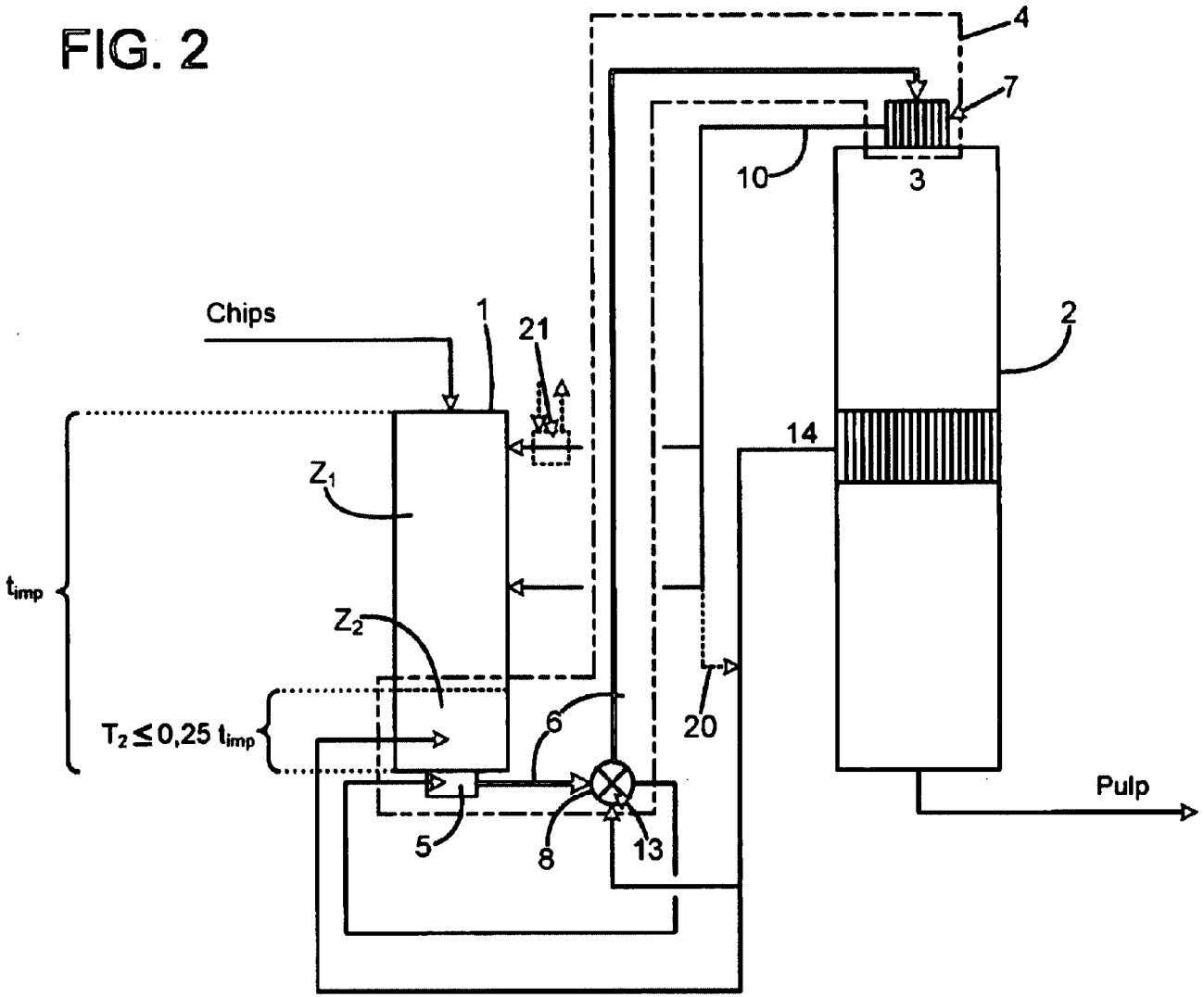
FIG. 2 shows schematically an alternative embodiment of a two-vessel digester in which the transfer system comprises a high-pressure feederfeeder.

FIGS. 1 and 2 show schematically a continuous two-vessel digester for the manufacture of cellulose pulp in which the invention is applied and in which the digester system comprises an impregnation vessel (1), a digester (2) and a transfer system (4) for transport of chips from the impregnation vessel (1) to the digester (2). The difference between FIG. 1 and FIG. 2 is constituted by the fact that the transfer system (4) in FIG. 2 comprises also a high-pressure feeder (8) of a conventional type, which makes impregnation possible in an unpressurised impregnation vessel. A high-pressure feeder is a sluice feed that is equipped with a rotor having pockets that pass symmetrically through it, and that through rotation are placed alternately in connection with a low-pressure and a high-pressure system without any communication being allowed between these two systems. The chips are transported from the outlet (5) on the low-pressure side into one of the pockets of the high-pressure feeder (8) and, once the pocket has been filled, the rotor rotates a quarter of one rotation such that the pocket arrives on the high-pressure side at a location for emptying where a transport fluid, in this case black liquor (14), expels the chips from the pocket for transport onwards towards the top (3) of the digester. The chips can, in this way, be carried from a system at zero pressure or at low pressure, typically 0–4 bar (abs) and they can be fed via the high-pressure feeder into a system with considerably higher pressure, typically 7–20 bar (abs).

Figure 3B:
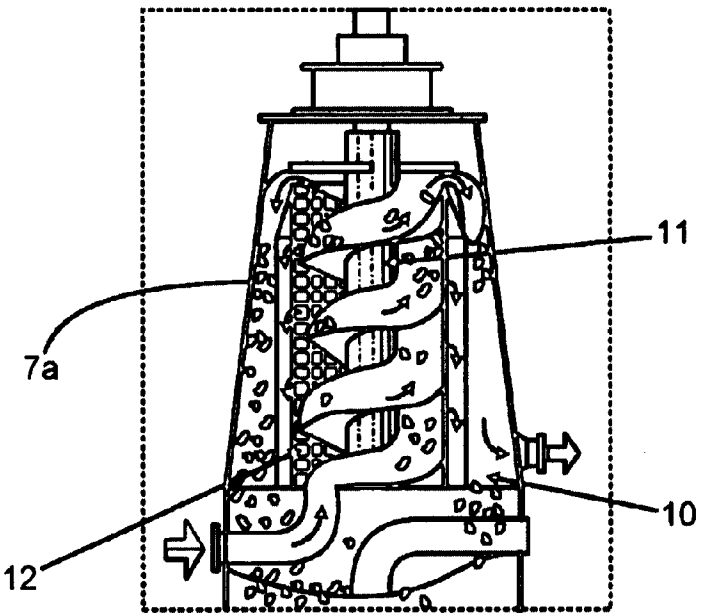
FIG. 3*b* shows in further detail a top separator for the separation of chips and transport fluid at the top of the digester.
Figure 3A:
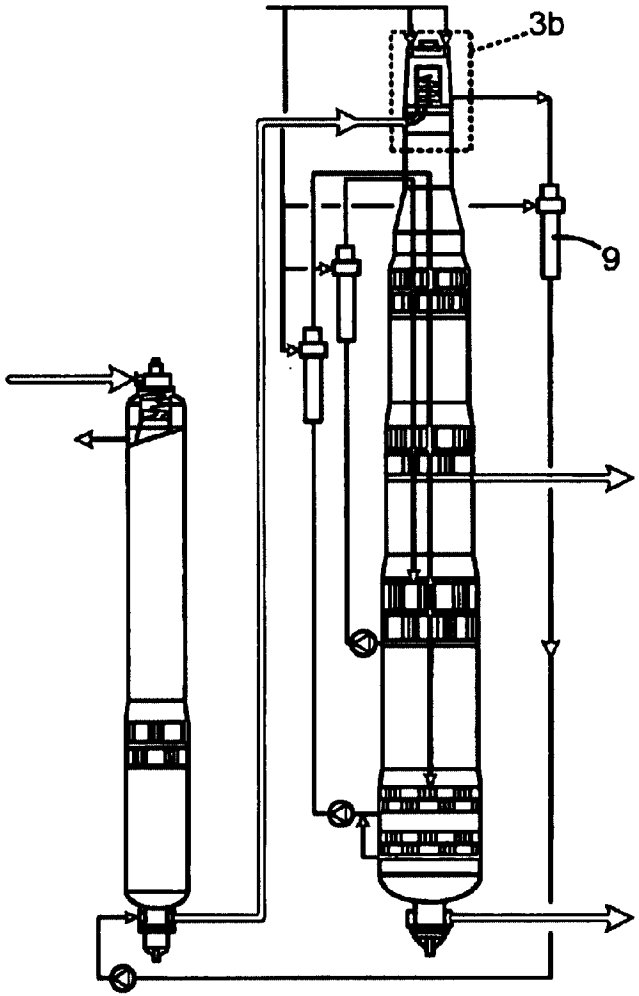
FIG. 3*a* shows a two-vessel steam/fluid phase digester.
Figure 4B:
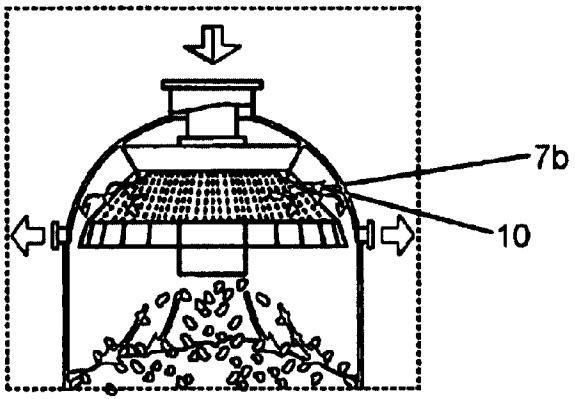
FIG. 4*b* shows in further detail the strainer section for the separation of chips and transport fluid at the top of the digester.

A digester (2) of steam/fluid phase type is shown in FIGS. 1 and 2 with a top separator (7) at the top, according to (7*a*) in FIG. 3*b*, but the invention can also be applied in a hydraulic digester system with a separation of chips and transport fluid in a strainer section in the top of the digester, according to (7*b*) in FIG. 4*b*. Those circulations that are not relevant to the invention, circulations of impregnation fluid and cooking fluid for the establishment of the correct fluid/wood ratio, alkali and temperature adjustments and withdrawal of fluid for the recovery of chemicals, are not shown in FIGS. 1 and 2, but it is to be understood that the invention can be applied in all types of digester system, such as, for example, MCC, EMCC, ITC, Lo-Solids, etc. Thus, both the impregnation vessel and the digester can be equipped with several circulations and withdrawals for process fluid in order to achieve different conditions, depending on the raw materials and the desired quality of the final cooked pulp, something that has been partially made clear in FIGS. 3*a* and 4*a*. For example, white liquor can be added in batches at the feed, at the impregnation vessel, or at the top zone, central zone or bottom zone of the digester. Impregnation vessels and digesters may be equipped both with zones of concurrent flow and countercurrent flow with withdrawal points for black liquor, and withdrawal of black liquor for recovery of chemicals can take place at several locations, such as, for example, from the impregnation vessel, from the return line of the transport fluid, or from the digester. These circulations and withdrawals can take place via conventional strainer sections, and they can also be constituted by strainer-less withdrawals that only consist of connection pieces (i.e. pipes) mounted in release positions in the walls of the vessel.

The invention will now be described in more detail based on FIGS. 1 and 2. What characterises the invention is the lack of a conventional transfer circulation between the. outlet (5) of the impregnation vessel and the inlet (3) of the digester to the extent that transport fluid (10) after separation from the chips in the separation equipment (7) at the top of the digester is not recirculated to the outlet (5) of the impregnation vessel. Hot black liquor (14) is, instead, used to transport the impregnated chips typically at a temperature in excess of 140° C., from one of the black liquor withdrawal points that is led to a final concurrent mixing zone ($Z_2$) in the impregnation vessel (1) and/or to the inlet (13) for transport fluid in the high-pressure feeder (8), in order there to be mixed into a chips mixture consisting of the impregnated chips and the accompanying impregnation fluid. The mixing zone ($Z_2$) and the high-pressure feeder (8) both constitute the beginning of a transfer system (4), a more accurate definition of which is given later. According to the invention, at least 25% and preferably 50% of the total amount of black liquor (14) that is withdrawn from the digester is to be led back in order in this way to be mixed with the chips mixture. The temperature of the chips mixture will in this way be raised during transport in the transfer system (4) and sufficient black liquor (14) is used in one preferred embodiment that no further heating is required. This will be the case when the temperature of the chips mixture is raised by between 5–25° C. as a consequence of the addition of black liquor. The withdrawn black liquor (14) has a temperature of $T_{av}$ which is essentially to be maintained until the black liquor is added in the transfer system. This means that no forced cooling via flashing, heat exchange or similar measures is carried out in order to cool the black liquor. The only cooling that may arise is that which naturally arises as heat loss from the tubes in which the black liquor is transported. A heating of the chips mixture normally takes place in a conventional transfer circulation by the transport fluid (10) being heated in a heat exchanger (9), see FIGS. 3 and 4, before it is returned to the outlet (5) of the impregnation vessel.

Part of the transport fluid (10) is separated from the chips mixture in separation equipment (7) at the inlet (3) of the digester, see FIGS. 3*b* and 4*b* for more detail. The hot transport fluid (10) is subsequently led fully or partially back to the impregnation vessel (1) and is added in a first zone ($Z_1$) before the final concurrent flow mixing zone ($Z_2$) in order in this way to constitute part of the impregnation fluid in this first zone ($Z_1$). The transport fluid (10) can be added at one or several locations in this first zone ($Z_1$) and the impregnation can take place under concurrent flow, countercurrent flow or both, depending on how the digester system is operated. It is desirable, in order to obtain a heating effect according to the invention, that the transport fluid (10) is allowed a retention time corresponding to 40% and preferably at least 50% of the total retention time $t_{imp}$ of the chips in the impregnation vessel (1). According to the innovative concept, an impregnation with black liquor is obtained at a lower temperature with this method than that obtained when the black liquor is led directly from the digester to the impregnation vessel. At the same time, the temperature in the transfer system is raised, which results in the heat exchanger that is normally required for heating in the transport circulation can be eliminated or reduced in size. As has been indicated in FIG. 2 (and as also applies to FIG. 1), a certain cooling of the transport fluid (10) that has been added to the impregnation vessel (1) at one location, preferably the upper location, can take place, in order to obtain in this way a successive heating of the chips during impregnation.

Black liquor is here used to denote cooking fluid that has been drawn from the digester (2) after a bulk delignification that is equivalent to at least 40% of the total bulk delignification has taken place, or after at least 50% of the total reduction in kappa value has taken place. However, the withdrawal must take place after a minimum of 30 minutes of cooking, in order for the fluid to be characterised as black liquor. One skilled in the arts will realise that the location of the withdrawal will vary depending on the particular method of cooking and the cooking conditions that are associated with the method, and can thus be constituted by a withdrawal at the beginning, the centre or the end of the digester in a concurrent flow zone or a countercurrent flow zone or as a withdrawal between an upper concurrent flow zone and a subsequent countercurrent flow zone. It is also possible to use more than one withdrawal.

The transfer system (4) comprises, when considered in the direction of flow of the chips:

- a final concurrent flow mixing zone ($Z_2$) in the impregnation vessel (1) with a retention time ($t_2$) for the chips in this mixing zone that constitutes a maximum of 25% of the retention time, $t_{imp}$, of the chips in the impregnation vessel such that $t_2 \leqq 0.25\ t_{imp}$,
- the outlet (5) of the impregnation vessel,
- a transfer line (6) between the outlet (5) of the impregnation vessel and the inlet (3) of the digester, possibly also comprising a high-pressure feeder (8), see FIG. 2, at a location after the outlet (5) of the impregnation vessel, and separation equipment (7) located in direct contact with the inlet (3) of the digester, or immediately underneath it, in order to separate transport fluid (10) from the chips mixture.

This separation equipment (7) in a steam/fluid phase digester consists of what is known as a top separator (7*a*), according to FIG. 3*b*, while in a hydraulic digester it consists of a strainer section (7*b*), according to FIG. 4*b*.

The beginning of the transfer system is here taken to denote in accordance with the above definition a final concurrent flow zone ($Z_2$) in the impregnation vessel (1), the outlet (5) of the impregnation vessel and the high-pressure feeder (8), if present.

FIG. 3*a* shows schematically a conventional two-vessel steam/fluid phase digester and FIG. 3*b* shows in more detail what is known as an upward-feed or inverted top separator (7*a*) in which chips and transport fluid are fed into the lower end of the top separator. The chips are fed upwards under the influence of the feed-screw (11) over the edge of the top separator and thus fall down into the digester. A fraction of the transport fluid (10) is withdrawn through the strainer (12) that surrounds the screw.

Figure 4A:
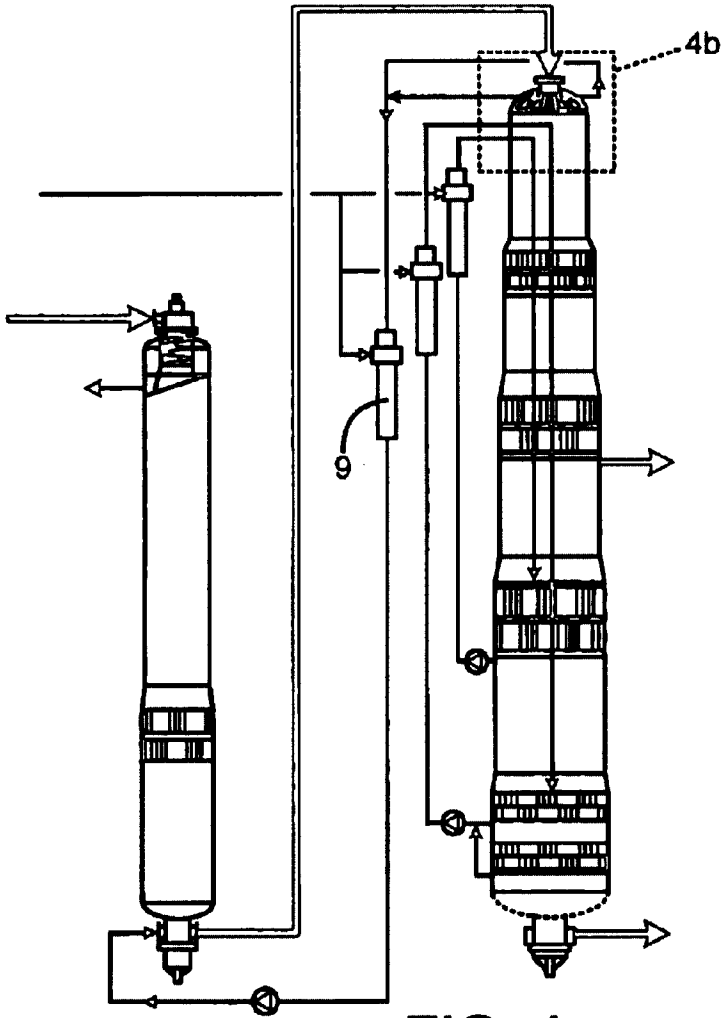
FIG. 4*a* shows a two-vessel hydraulic digester.

FIG. 4*a* shows schematically a two-vessel hydraulic digester and FIG. 4*b* shows in more detail the strainer section (7*b*) for separation of the chips and transport fluid (10) at the top of the digester.

The invention can be modified in several ways within the framework of the claims. The black liquor 14 from the black liquor withdrawal that is added to the transfer system can thus be added only at one of the three locations shown, or at combinations of two of these.

Furthermore, a shunt line (20) can also be used, for example during the start of the process, when the digester is filled with the impregnated chips and before black liquor of the correct temperature and with the correct level of residual alkali content has been established. This shunt line may then be closed once operation has been established. Depending on where black liquor is withdrawn for recovery of chemicals, and on other factors, this shunt line can also be used to establish different ratios of fluid to wood in the impregnation vessel, the transfer system or the digester, and the fluid flow can thus pass in both directions in this line, depending on the method of operation of the system.

In the claims:

1. A method for the continuous cooking of chemical pulp to improve heat economy in the digester system, comprising:

providing an impregnation vessel having an inlet defined therein, the impregnation vessel being in fluid communication with a digester via a transfer system, the digester having an outlet defined therein;

feeding a mixture of cellulose chips and process fluid into the inlet of the impregnation vessel; impregnating the cellulose chips in the impregnation vessel at a predetermined impregnation temperature $T_{imp}$;

feeding the impregnated cellulose chips to the digester through the transfer system; cooking the impregnated cellulose chips at a predetermined temperature $T_{cook}$;

feeding pulp dissolved in the digester out through the outlet of the digester:

withdrawing black liquor from the digester via a cooking withdrawal after partial or complete cooking of the cellulose chips; leading the withdrawn black liquor to the transfer system at a bottom of the impregnation vessel;

mixing the withdrawn black liquor with the impregnated cellulose chips in the transfer system for transport onwards to a top of the digester;

adding a part of the black liquor from the black liquor withdrawal to an addition point of the impregnation vessel without cooling the withdrawn black liquor, the black liquor having a withdrawal temperature $T_{av}$, to a beginning of the transfer system, the black liquor having maintained essentially the temperature $T_{av}$, to raise a temperature of a chips mixture in the transfer system;

a transport fluid being continuously withdrawn from the chips mixture at an end of the transfer system, the transport fluid maintaining a transport temperature $T_{transp}$; and returning the transport fluid to the impregnation vessel without heating at a location that is upstream of the transfer system and the addition point of the black liquor wherein the black liquor from the black liquor withdrawal maintains a temperature of Tav that exceeds the temperature Ttransp of the transport fluid that is withdrawn from the top of the digester by at least 50°C., such that $T_{av}-T_{transp} \geqq 5°$ C.

2. The method according to claim 1, wherein the fraction of black liquor from the black liquor withdrawal that is led to the transfer system constitutes at least 25% of the total amount of black liquor that is withdrawn from the digester.

3. The method according to claim 1 wherein the fraction of withdrawn transport fluid that is returned to the impregnation vessel constitutes at least 10% of the total amount of the transport fluid withdrawn from the top of the digester.

4. The method according to claim 3, wherein the black liquor from the black liquor withdrawal that is led to the transfer system maintains a withdrawal temperature $T_{av}$ that is essentially equivalent to the cooking temperature $T_{cook}$ and does not deviate from the cooking temperature by more than a maximum of 5° C.

5. The method according to claim 4, wherein the fraction of transport fluid withdrawn, which maintains a transfer temperature of $T_{transp}$, is returned to the impregnation vessel with an essentially maintained transfer temperature $T_{transp}$ in at least one location in the impregnation vessel.

6. The method according to claim 3, the transport fluid that has been withdrawn and that is returned to the impregnation vessel is given a period as impregnation fluid in the impregnation vessel for at least 40% of the total retention time $t_{imp}$ of the chips in the impregnation vessel.

7. The method according to claim 1 wherein the black liquor from the black liquor withdrawal is added to a final mixing zone ($Z_2$) in the impregnation vessel.

8. The method according to claim 1 wherein the black liquor from the black liquor withdrawal is added at an outlet from the impregnation vessel.

9. The method according to claim 8, wherein the final mixing zone ($Z_2$) in the impregnation vessel corresponds to a retention time ($t_2$) for the chips of a maximum of 25% of the total retention time ($t_{imp}$) for the chips in the impregnation vessel.

10. The method according to claim 9, wherein the final mixing zone ($Z_2$) in the impregnation vessel is a zone of concurrent flow.

11. The method according to claim 1 wherein a fraction of the black liquor from the black liquor withdrawal is added at a high-pressure location in the transfer system, where this high-pressure location is located in association with the inlet for transport fluid on the high-pressure side of a high-pressure feeder.

12. The method according to claim 11, wherein the black liquor from the black liquor withdrawal that is added at the inlet for transport fluid on the high-pressure side of the high-pressure feeder is constituted by the complete amount that is required in order to expel the chips from the high-pressure feeder in the high-pressure location.

13. The method according to claim 12, wherein the complete amount of black liquor from the black liquor withdrawal that is led to the transfer system is added at the inlet for transport fluid at the high-pressure side of a high-pressure feeder.

* * * * *

UNITED STATES PATENT AND TRADEMARK OFFICE

CERTIFICATE OF CORRECTION

PATENT NO. : 7,112,256 B2
APPLICATION NO. : 10/250886
DATED : September 26, 2006
INVENTOR(S) : Vidar Snekkenes et al.

It is certified that error appears in the above-identified patent and that said Letters Patent is hereby corrected as shown below:

Col. 8, line 23, of claim 1 should be amended to read:

"~~50º~~ 5ºC, such that $T_{av} - T_{transp} \geq 5^{o}C$"

Signed and Sealed this

First Day of June, 2010

David J. Kappos

David J. Kappos
*Director of the United States Patent and Trademark Office*